US007543633B2

(12) United States Patent
Brown et al.

(10) Patent No.: US 7,543,633 B2
(45) Date of Patent: Jun. 9, 2009

(54) FLOATING SHAFT GAS SEPARATOR

(75) Inventors: Donn J. Brown, Broken Arrow, OK (US); Brown Lyle Wilson, Tulsa, OK (US); Matthew R. Porter, Tulsa, OK (US); Bruce Proctor, Tulsa, OK (US)

(73) Assignee: Baker Hughes Incorporated, Houston, TX (US)

( * ) Notice: Subject to any disclaimer, the term of this patent is extended or adjusted under 35 U.S.C. 154(b) by 297 days.

(21) Appl. No.: 11/392,284

(22) Filed: Mar. 29, 2006

(65) Prior Publication Data

US 2007/0235196 A1 Oct. 11, 2007

(51) Int. Cl.
*E21B 43/38* (2006.01)

(52) U.S. Cl. ..... 166/105.5; 166/378

(58) Field of Classification Search ..... 166/68.5, 166/105, 105.5, 265, 378, 369; 403/359.1; 417/201, 423.3
See application file for complete search history.

(56) References Cited

U.S. PATENT DOCUMENTS

| | | | | |
|---|---|---|---|---|
| 2,311,963 | A * | 2/1943 | Pyle | 417/203 |
| 5,015,162 | A * | 5/1991 | Heppner | 418/48 |
| 6,561,775 | B1 * | 5/2003 | Wefers | 417/423.3 |
| 6,675,902 | B2 * | 1/2004 | Rowan et al. | 166/381 |
| 6,705,402 | B2 | 3/2004 | Proctor | |
| 6,868,912 | B2 * | 3/2005 | Proctor | 166/378 |

* cited by examiner

*Primary Examiner*—Jennifer H Gay
*Assistant Examiner*—Daniel P Stephenson
(74) *Attorney, Agent, or Firm*—Bracewell & Giuliani LLP

(57) ABSTRACT

A progressing cavity pump is located within a well and has a gas separator for separating gas before reaching the pump. The pump has a rotor that is driven by a string of rods extending to the surface. A drive shaft for the gas separator is coupled to the rotor during pumping operation both for axial as well as rotational movement. The rotor assembly, when lowered through the tubing, stabs into engagement with the drive shaft of the gas separator in one version. In another version, the gas separator drive shaft is lowered through the tubing with the rotor and stabs into a hub sleeve in the gas separator.

19 Claims, 5 Drawing Sheets

FLOATING SHAFT GAS SEPARATOR

FIELD OF THE INVENTION

This invention relates in general to submersible well pumping assemblies, and in particular, to a rod-driven progressing cavity pump assembly with a gas separator.

BACKGROUND OF THE INVENTION

One use for a progressing cavity pump is as a well pump. A progressing cavity pump has a stator with an elastomeric liner in its interior. The liner has a passage through it that has a helical contour. A helical rotor, typically of metal, locates within the stator and is rotatable relative to it. Rotating the rotor causes the well fluid to pump through the stator.

In one type of installation, the stator is secured to the lower end of a string of tubing that is suspended in the well. The rotor is secured to a string of drive rods and lowered through the tubing into the stator. After reaching the lowermost point, the operator lifts the rods and rotor a short distance to properly align the rotor with the stator. The drive rods are driven by a drive source at the surface, typically a bearing box and electrical motor. As the well fluid fills the tubing, the rods will stretch to some extent due to the weight of the well fluid. The rotor will thus move downward a short distance relative to the stator.

Some wells produce a combination of liquid and gas. The gas entrained within the liquid is detrimental to the efficiency of the progressing pump. Gas separators have been utilized with electrical submersible well pumps for many years. One type of gas separator has a rotating member, typically a set of vanes that spins with the pump to impart centrifugal force to the well fluid. The centrifugal force results in the heavier components flowing to the outer portion and the lighter components are gas remaining in the center. A crossover member at the top diverts the gas out into the casing and directs the liquid component up into the pump.

The centrifugal pump is made up of a large number of stages of impellers and diffusers. A centrifugal pump is not driven by rods and does not experience any downward movement of the drive shaft as a result of the weight of liquid in the tubing.

Progressing cavity pumps with gas separators are known, both for rod-driven types as well as the type that utilizes a downhole submersible electrical motor to drive the rotor. However, provisions to accommodate the rod stretch for the rod-driven type are not known in the prior art.

SUMMARY OF THE INVENTION

In this invention, a gas separator is secured to the lower end of the stator of a progressing cavity pump assembly. The gas separator is of a rotary type, having a rotary member for imparting centrifugal force to the well fluid flowing into the gas separator. The gas separator has a drive shaft that is operably engaged by the rotor for causing rotation of the rotary member.

The rotor is axially movable a limited amount relative to the stator during operation of the pump as a result of stretch of the rods. The drive shaft is axially movable in unison with the rotor after it is in operative engagement with the stator.

In one embodiment of the invention, the drive shaft is fixed to the rotary member, and both the drive shaft and the rotary member are movable axially within the housing of the gas separator. The rotor has a flex shaft on its lower end with a splined end that stabs into engagement with a coupling on the upper end of the gas separator drive shaft. Once in engagement, the drive separator drive shaft and the rotor are axially movable as well as rotationally movable in unison with each other.

In another embodiment, the drive shaft is secured to the lower end of the rotor at the surface and lowered through the tubing with the drive rods. The drive shaft stabs into a bushing located in the rotary member of the gas separator. The bushing has splines that engage splines on the lower end of the drive shaft. The drive shaft is movable in unison with the rotor, both axially and rotationally, but the rotary member is only rotationally engaged with the drive shaft.

DETAILED DESCRIPTION OF THE PREFERRED EMBODIMENT

Figure 1A:
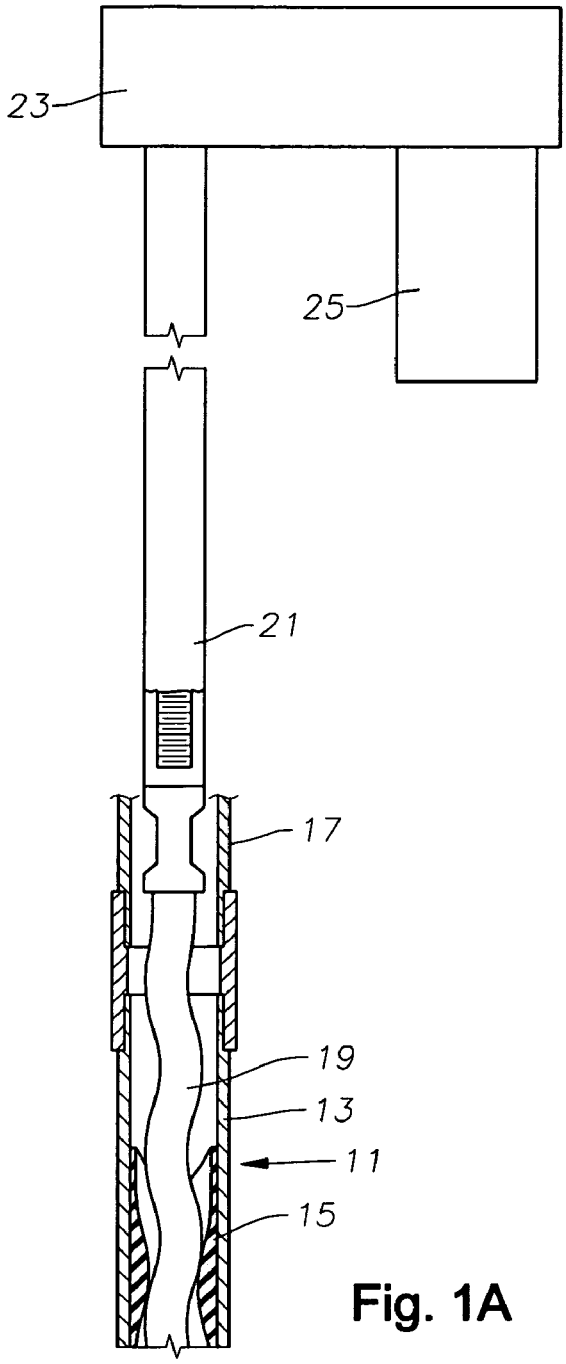
FIGS. 1A and 1B comprise a side view, partially sectioned, of a well pump assembly constructed in accordance with this invention.

Referring to FIG. 1, progressing cavity pump 11 is conventional. Pump 11 has a stator 13 that has a tubular housing containing an elastomeric liner 15. Liner 15 has a passage through it that has a double helical contour. Stator 13 is secured to the lower end of a string of production tubing 17 that extends into the well. Tubing 17 extends to the surface of the well for delivering well fluid. Tubing 17 may comprise sections of conventional well production tubing screwed together. Alternatively, tubing 17 could comprise a single continuous length of coiled tubing.

Pump 11 includes a rotor 19 that rotates within stator 13. Rotor 19 is typically of metal and has a single helical contour. A string of drive rods 21 extends form the surface to rotor 19 for rotating rotor 19. Drive rods 21 typically comprise sections of rods secured together by threads.

A bearing box 23 located at the surface is driven by a motor 25, normally an electrical motor. Bearing box 23 engages the upper end of drive rods 21 for rotating drive rods 21 and rotor 19.

Rotor 19 orbits or oscillates as it rotates, rather than remaining on a single concentric axis. A flex shaft 27 is secured to the lower end of rotor 19, and for the purposes herein, may be considered to be a part of rotor 19. Flex shaft 27 is typically a steel rod that has sufficient length to allow flexing. The lower end of flex shaft 27 is constrained about a single axis while the upper end of flex shaft 27 is free to orbit with the lower end of rotor 19. Flex shaft 27 extends through a flex shaft housing 29 that contains bearings for supporting the lower end of flex shaft 27. Flex shaft housing 29 does not have an elastomeric liner 15 within it, but could be integrally formed with the housing of stator 13 and may be considered a part of stator 13.

Figure 2A:
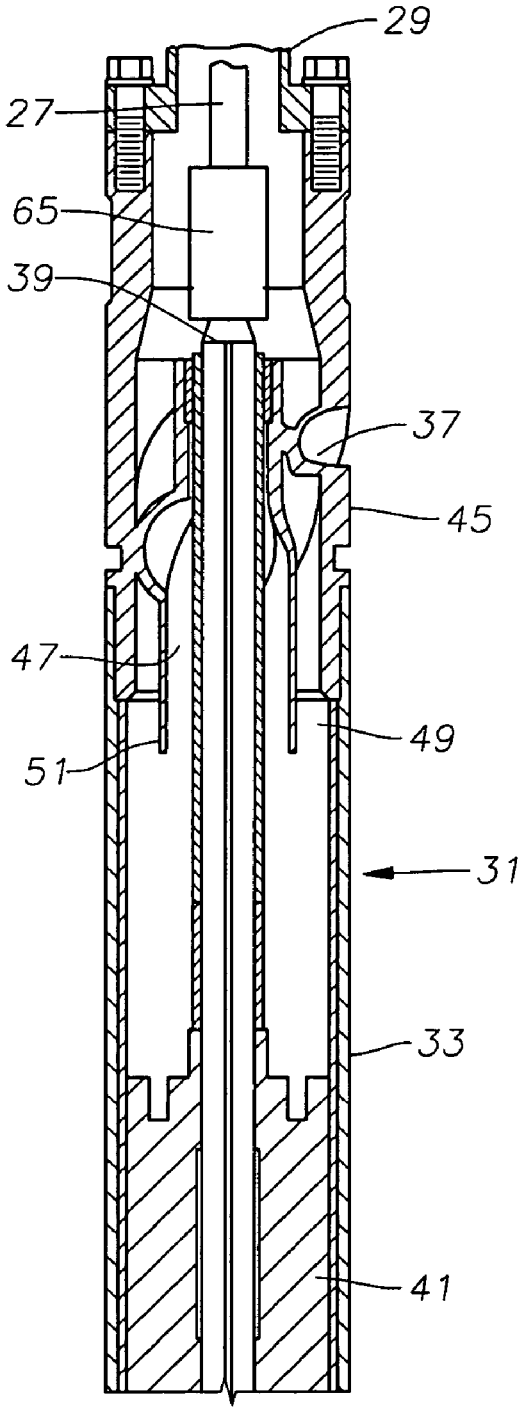
FIGS. 2A and 2B comprise a sectional view of the pump and gas separator of FIGS. 1A and 1B and showing the drive shaft and rotary members in a lower position.
Figure 2B:
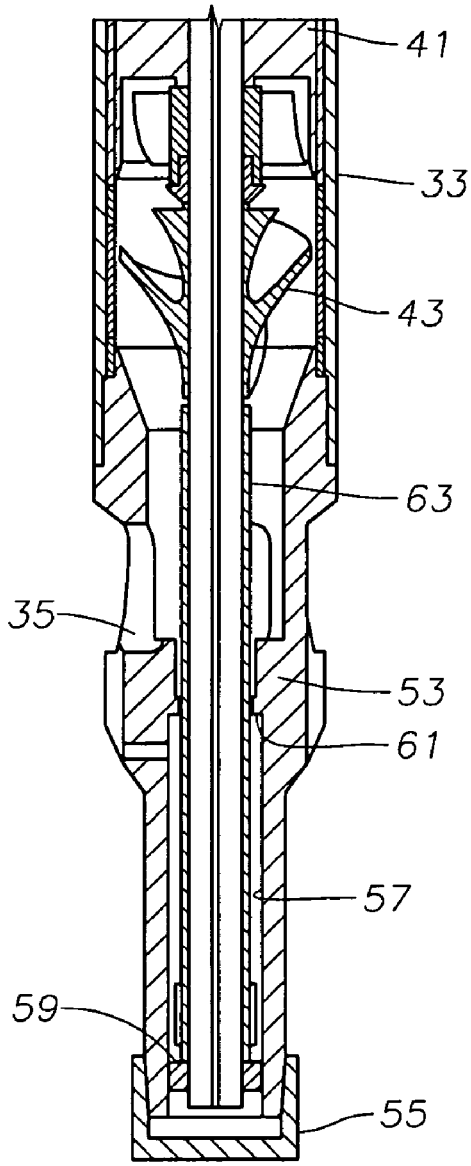

A gas separator 31 is carried below flex shaft housing 29. Gas separator 31 has a lower intake 35 for drawing well fluid into it and a gas discharge 37 near its upper end for discharging separated gas into the well. Gas separator 31 has a drive shaft 39 that is rotated by drive rods 29, rotor 15 and flex shaft 27. Referring to FIGS. 2A and 2B, gas separator 31 may be of a variety of rotary types. In this embodiment, gas separator 31 has a set of vanes 41 that rotate with drive shaft 39 to impart centrifugal force to the well fluid. Vanes 41 comprise a plurality of flat blade-like members, each being in a plane that is perpendicular to the axis of drive shaft 39 in this embodiment. The centrifugal force imparted by vanes 41 causes the heavier components to flow radially outward while the lighter components of the well fluid remain in the central area.

An inducer 43 optionally may be incorporated with gas separator 31. Inducer 43 is a type of pump for inducing the flow of well fluid into gas separator 31. In this embodiment, inducer 43 has a helical vane, similar to an auger for forcing well fluid upward into vanes 41. Inducer 43 has a key, like vanes 41, that causes it to rotate in unison with gas separator drive shaft 39.

Figure 3A:
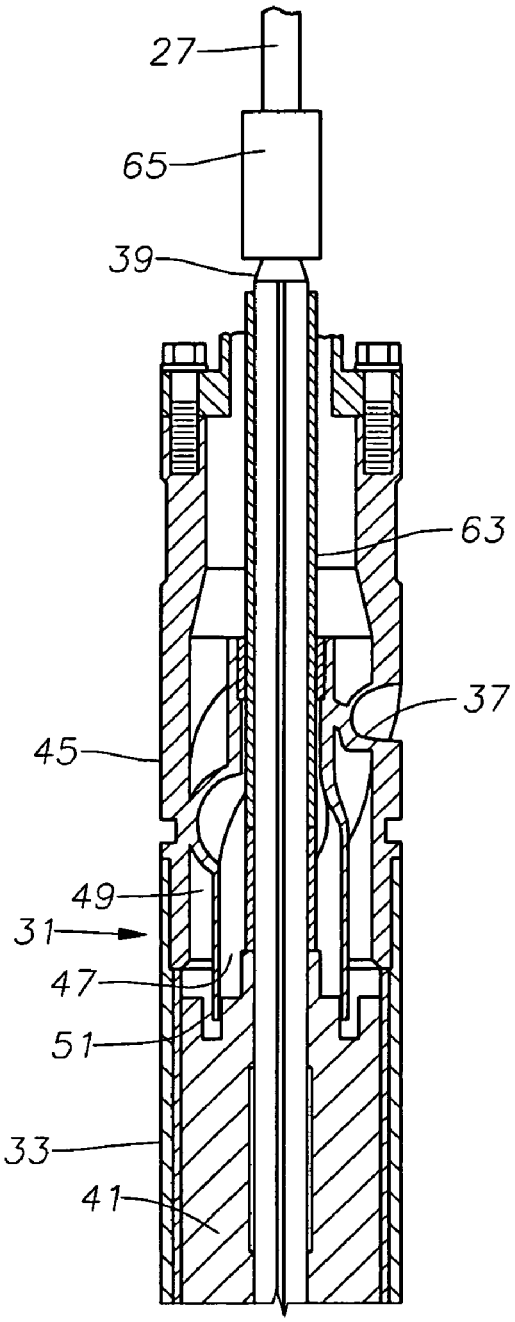
FIGS. 3A and 3B comprise a sectional view of the pump and gas separator of FIG. 1, and showing the rotary members and drive shaft in an upper position.
Figure 3B:
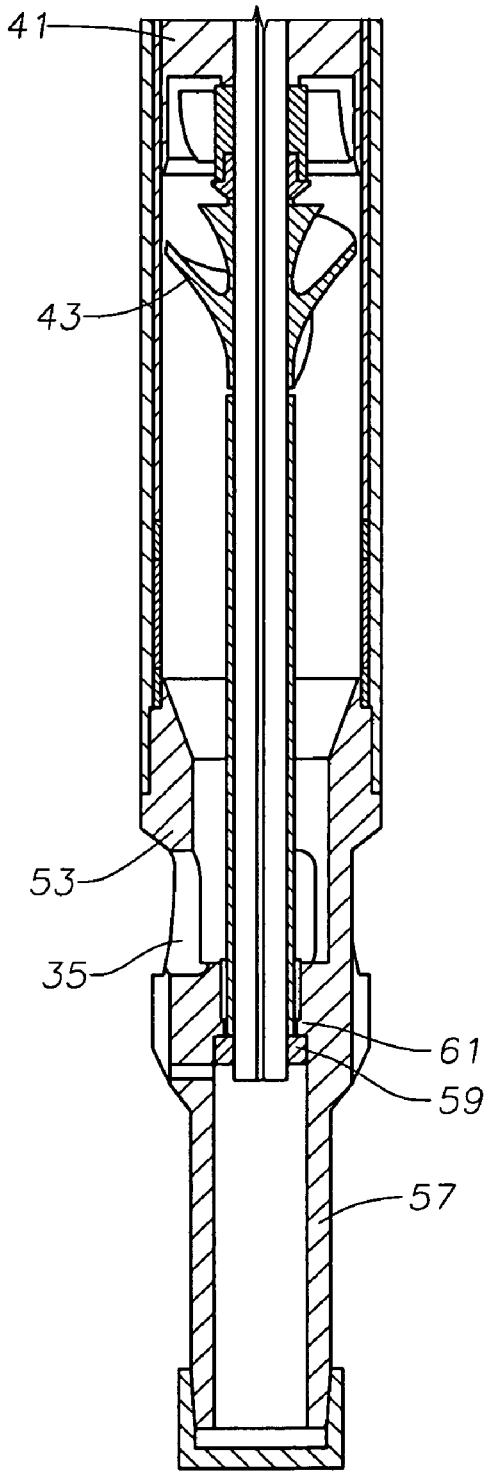
Figure 4:
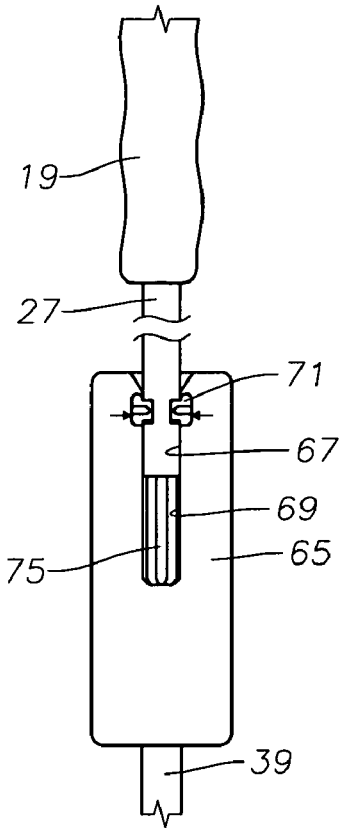
FIG. 4 is a schematic sectional view illustrating a coupling between the rotor assembly and the gas separator drive shaft in accordance with this invention.

A crossover 45 is located at the upper end of gas separator housing 33. Crossover member 45 has an inner passage 47 that leads to gas discharge port 37. Crossover member 45 has an outer passage 49 that leads upward into flex shaft housing 29. Crossover member 45 has an annular skirt 51 that depends downward and divides inner passage 47 from outer passage 49 at the entrance. A base member 53 secures to the lower end of gas separator housing 33. Base member 53 may be used to connect gas separator 31 to other equipment, or it may have a cap 55 at the lower end. Base member 53 has an extension section 57 that extends downward below intake 35. Drive shaft 39 has a lower end that extends into the extended section and is retained herein by a retaining ring 59. Drive shaft 39 is movable between a lower position shown in FIG. 2B and an upper position shown in FIG. 3B. In the lower position, retaining ring 59 is located at the lower end of extension section 57. In FIG. 3B, retaining ring 59 abuts a bushing or bearing member 61 located at the upper end of extension section 57.

In this embodiment, vanes 41 and inducer 43 are secured to drive shaft 39 for axial movement as well as rotational movement. The length of housing 33 is greater than the axial length of the rotary components made up of vanes 41 and inducer 43 to accommodate this axial movement. In FIG. 2A, a substantial space exists between the upper edge of vanes 41 and skirt 51. When in the upper position shown in FIG. 3A, the upper edge of vanes 41 engages skirt 51. Drive shaft 39 may have a protective sleeve 63 or bushing surrounding it both in the lower section from inducer 43 to retaining ring 59 as well as in the upper section above vanes 41.

In the embodiment of FIGS. 1-5, drive shaft 39 is assembled with gas separator 31 at the surface and lowered into the well on tubing 17. Rotor 19 and flex shaft 27 (FIGS. 1A-1B), are lowered through tubing 17 on drive rods 21. A coupling 65 connects flex shaft 27 to drive shaft 39 when rotor 19 is fully inserted into stator 13. Once engaged, coupling 65 will cause drive shaft 39 to rotate with flex shaft 27 and also will cause drive shaft 39 to move axially with flex shaft 27 and rotor 19. Coupling 65 may be of a variety of types. In this embodiment, coupling 65 is secured to the upper end of drive shaft 39, shown in FIG. 4. Coupling 65 has a receptacle 67 on its upper end for receiving the lower end of flex shaft 27. Receptacle 67 has a plurality of internal splines 69. A latch ring 71 is mounted within receptacle 67. Latch ring 71 is a split ring that is by standard for engaging an annular groove 73 (FIG. 5) located on flex shaft 27. Flex shaft 27 has a lower splined end 75 which mates with splines 69.

In the operation of the embodiment of FIGS. 1-6, the operator secures gas separator 31 to stator 13. In this embodiment, this is accommodated by securing gas separator 33 to flex shaft housing 29. Drive shaft 39 will be located within gas separator 33. The operator lowers gas separator 33 on the string of tubing 17.

Figure 5:
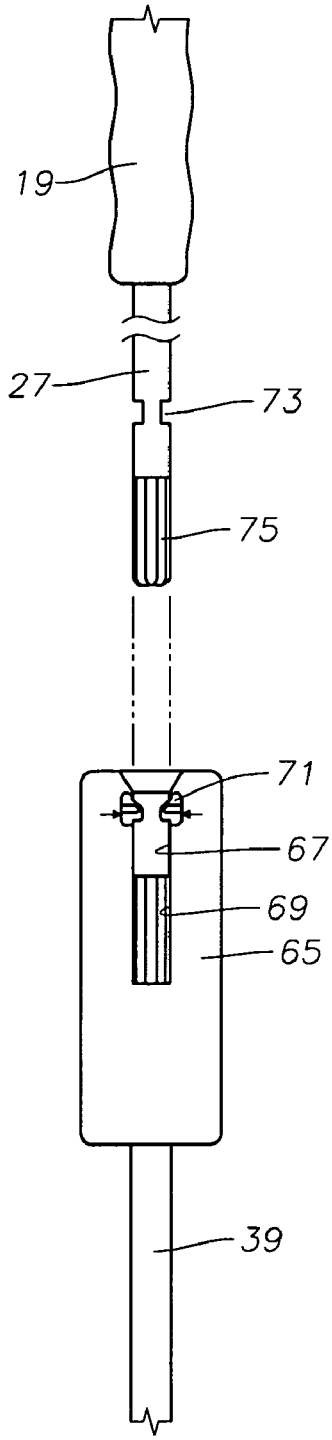
FIG. 5 is a view of the coupling of FIG. 4, but showing the rotor disengaged from the coupling.

The operator then connects flex shaft 27 to rotor 19 and lowers rotor 19 through tubing 17 on drive rods 21. When rotor 19 reaches the lower end of stator 13, flex shaft 27 will engage gas separator drive shaft 39. Referring to FIG. 5, lower end 75 of flex shaft 27 stabs into receptacle 67, and latch ring 71 engages groove 73. At this point, drive shaft 39, vanes 41 and inducer 43 will be in the lower position shown in FIGS. 2A and 2B.

The operator then lifts drive rods 21 a measured distance to place rotor 19 with its upper end a selected distance above the upper end of stator liner 15. Drive shaft 39 of gas separator 33 will move upward, bringing along with it vanes 41 and inducer 43. This position will be located either at the uppermost position shown in FIGS. 3A and 3B, or some slightly lower position. The position will be selected to account for the stretch of rods 21 when tubing 17 is filled with liquid, and the amount of stretch will depend upon the length of rods 21.

Figure 1B:
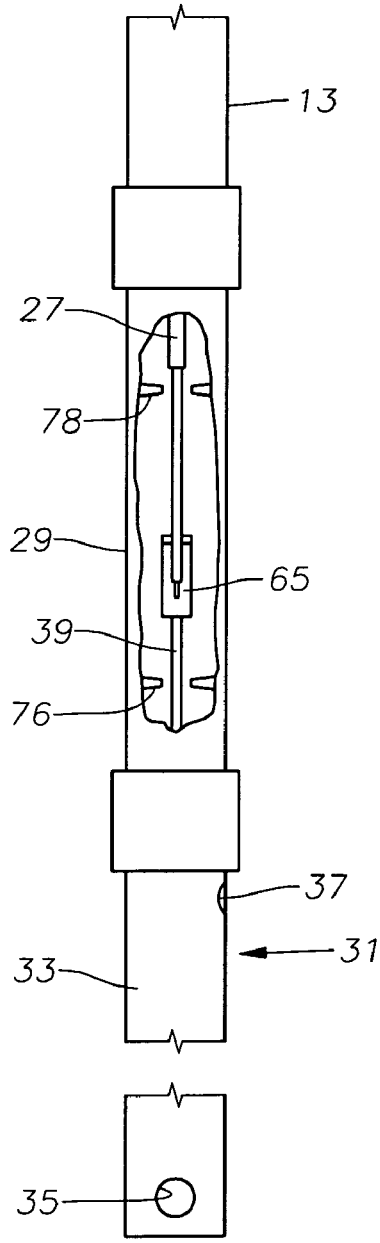

The operator then actuates motor 25 to rotate rods 21, which in turn rotates rotor 19 and gas separator drive shaft 39. Inducer 43 rotates to assist in drawing well fluid in through intake 35. The well fluid flows through the rotating vanes 41, which through centrifugal force forces the liquid to the outer side relative to the gaseous components which remain in the central area. The liquid flows up outer passage 49 and into stator 13 (FIG. 1A). The liquid is pumped by rotor 19 up tubing 17 to the surface. The gas flows through inner passage 47 (FIG. 2A) out gas discharge 37 into the well. The liquid within tubing 17 will gradually cause rods 21 to stretch. As rotor 19 and flex shaft 27 move downward, rotor drive shaft 39 also moves downward along with vanes 41 and inducer 43. The amount of downward movement is pre-calculated so as to avoid vanes 41 and inducer 43 reaching the lowermost position shown in FIGS. 2A and 2B.

Figure 7:
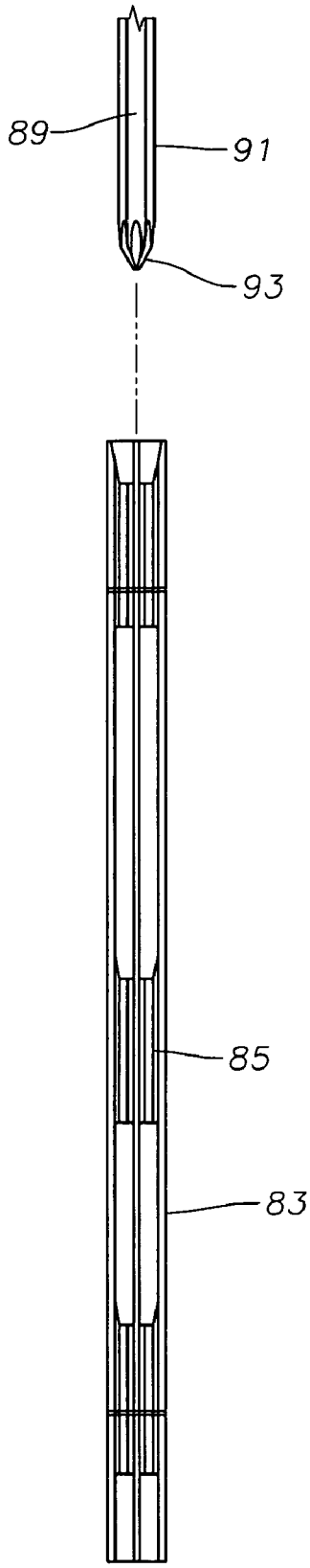
FIG. 7 is an exploded sectional view of a portion of a drive shaft and hub sleeve of the gas separator of FIGS. 6A and 6B.
Figure 6A:
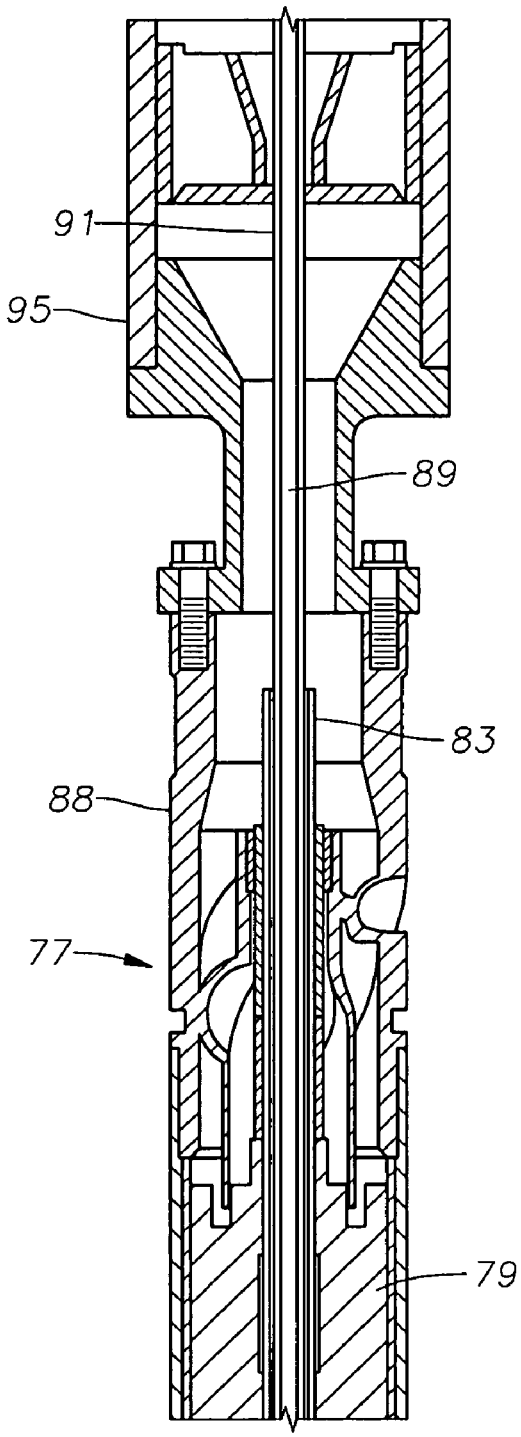
FIG. 6 is a sectional view of an alternate embodiment of a pump and gas separator in accordance with this invention.

To retrieve rotor 19, the operator exerts sufficient pull with drive rods 21 to over-pull latch ring 71 (FIG. 4), causing it to release from coupling 65, which remains downhole. In the embodiment of FIGS. 6 and 7, gas separator 77 also has a rotary member which comprises vanes 79 and an optional inducer 81. Vanes 79 and inducer 81 are linked together by an elongated hub sleeve 83. Hub sleeve 83 has internal splines 85 within it, either continuous or in sections as shown in FIG. 7. As shown in FIG. 6, hub sleeve 83 extends downward into a lower bearing support 87. The upper end of hub sleeve 83 preferably extends above crossover member 88.

Drive shaft 89 is carried by rotor 19 (FIG. 1A) as rotor 19 is lowered through tubing 17. Drive shaft 89 may comprise a portion of a flex shaft, or may be coupled to a flex shaft such as flex shaft 27 in the first embodiment. Drive shaft 89 has a section containing splines 91 that will mate with splines 85 in hub sleeve 83. Drive shaft 89 may also have a pointed tip 93, shown in FIG. 7, to facilitate stabbing into hub sleeve 83.

Figure 6B:
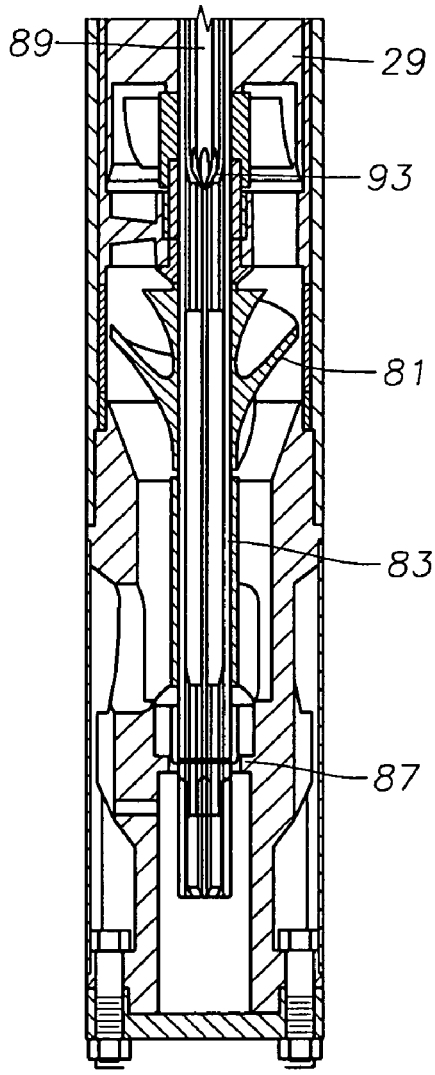

In the operation of the embodiment of FIGS. 6 and 7, gas separator 77 is secured to tubing 17 and lowered into place in the same manner as in FIG. 1, except that it does not contain a drive shaft. The operator then connects drive shaft 89 to the lower end of rotor 19 and lowers the assembly through tubing 17. As rotor 19 reaches the lower end of stator 13, drive shaft 89 will enter hub sleeve 83 and slide to the position shown in FIG. 6B. After reaching the lowermost position, the operator picks up drive rods 21 a selected distance to accommodate for stretch of drive rods 21 as in the first embodiment. The second embodiment operates in the same manner as in the first embodiment except vanes 79 and inducer 81 are not axially movable within gas separator 77. Rather, only drive shaft 89 is axially movable in unison with rotor 19 (FIG. 1A).

The invention has significant advantages. The floating drive shaft of the gas separator allows for expansion and contraction of the rod string driving the unit. The floating shaft gas separator can be designed with varying axial movable links.

While the invention has been shown in only two of its forms, it should be apparent to those skilled in the art that it is not so limited but susceptible to various changes without departing from the scope of the invention.

The invention claimed is:

1. A well pump apparatus having a progressing cavity pump stator secured to a lower end of a string of tubing, and a rotor carried on a lower end of a string of drive rods lowered through the tubing and into engagement with the stator, the improvement comprising:

a gas separator secured to a lower end of the stator for separating liquid and gas components of the well fluid, the gas separator having a rotary member for imparting centrifugal force to well fluid flowing into the gas separator;

a drive shaft within the gas separator and operatively engaged by the rotor for rotating the rotary member; wherein the rotor is axially movable a limited amount relative to the stator during operation of the pump apparatus resulting from stretch of the rods;

the drive shaft is axially movable in unison with the rotor after it is in operative engagement with the rotor;

a flex shaft is secured to a lower end of the rotor for being lowered through the tubing with the rotor during installation; and wherein the flex shaft stabs into operative engagement with the drive shaft when reaching a lowest position.

2. The apparatus according to claim 1, wherein the rotary member is axially movable with the drive shaft and the rotor after the drive shaft is in operative engagement with the flex shaft.

3. The apparatus according to claim 1, further comprising:

a coupling that operatively couples the flex shaft to the drive shaft for rotational and axial movement when the drive rods and rotor reach a lowest position upon being lowered through the tubing.

4. The apparatus according to claim 1, wherein the rotary member comprises:

a plurality of vanes;

an inducer having a helical flight; and wherein the vanes and the inducer move axially with the drive shaft after the drive shaft is in operative engagement with the flex shaft.

5. A well pump apparatus having a progressing cavity pump stator secured to a lower end of a string of tubing,and a rotor carried on a lower end of a string of drive rods lowered through the tubing and into engagement with the stator, the improvement comprising:

a gas separator secured to a lower end of the stator for separating liquid and gas components of the well fluid, the gas separator having a rotary member for imparting centrifugal force to well fluid flowing into the gas separator;

a drive shaft within the gas separator and operatively engaged by the rotor for rotating the rotary member; wherein the rotor is axially movable a limited amount relative to the stator during operation of the pump apparatus resulting from stretch of the rods;

the drive shaft is axially movable in unison with the rotor after it is in operative engagement with the rotor; and the drive shaft is carried by the rotor as the drive rods are being lowered through the tubing.

6. The apparatus according to claim 5, wherein the drive shaft is axially movable relative to the rotary member.

7. The apparatus according to claim 5, wherein:

the rotary member has a hub with a passage therein, the passage having at least one drive shoulder therein; and the drive shaft stabs into the passage in the hub when the drive rods and rotor are being lowered through the tubing, the drive shaft having at least one drive shoulder for transmitting rotating to the hub and the rotary member, the drive shaft being axially movable relative to the hub during operation of the pump apparatus.

8. The apparatus according to claim 5, wherein:

the drive shaft has a splined lower end; and wherein the apparatus further comprises:

a sleeve extending through the rotary member and having internal splines for receiving the splined lower end of the drive shaft.

9. A well pump apparatus, comprising:

a progressing pump stator for securing to a string of tubing;

a rotor adapted to be lowered into the stator through the tubing on a string of drive rods;

a gas separator housing secured to a lower end of the stator;

a rotary member rotatably carried in the housing for imparting centrifugal force to well fluid flowing into the housing to cause separation of liquid and gas components of the well fluid;

a drive shaft within the housing for rotating the rotary member;

the rotary member and the drive shaft being movable axially in unison within the housing between lower and upper positions; and a coupling that operatively connects the rotor to the drive shaft for rotational and axial movement therewith as the rotor is lowered into the stator.

10. The apparatus according to claim 9, wherein after the coupling operatively connects the rotor to the drive shaft, upward movement of the rotor causes the rotary member and the drive shaft to move toward the upper position, and downward movement of the rotor causes the rotary member and the drive shaft to move toward the lower position.

11. The apparatus according to claim 9, wherein the coupling is releasable to enable the rotor and the drive rods to be retrieved through the tubing while the drive shaft and the rotary member remain in the housing of the gas separator.

12. The apparatus according to claim 9, wherein the coupling operatively connects the rotor to the drive shaft in response to straight downward movement of the rotor relative to the drive shaft.

13. The apparatus according to claim 9, wherein the rotary member comprises:

a plurality of vanes; and an inducer having a helical flight.

14. A well pump apparatus, comprising:

a progressing pump stator for securing to a string of tubing;

a rotor adapted to be lowered into the stator through the tubing on a string of drive rods;

a gas separator housing secured to a lower end of the stator;

a rotary member rotatably carried in the housing for imparting centrifugal force to well fluid flowing into the housing to cause separation of liquid and gas components of the well fluid; and a drive shaft carried by the rotor for rotary and axial movement therewith, the drive shaft stabbing into operational engagement with the rotary member as the rotor is lowered into the stator, the drive shaft being axially movable relative to the rotary member in unison with the rotor while in operational engagement with the rotary member.

15. The apparatus according to claim 14, further comprising:

a splined hub within the rotary member; and a splined lower end on the drive shaft for reception within the splined hub.

16. A method for producing a well, comprising:

(a) connecting a gas separator having a rotary member therein to a progressing pump stator;

(b) lowering the stator and the gas separator into the well on a string of tubing;

(c) lowering a rotor on a string of drive rods through the tubing and into engagement with the stator;

(d) operatively engaging a drive shaft of the gas separator with the rotor for rotational and axial movement in unison therewith;

(e) rotating the drive rods and thereby the rotor and the drive shaft, causing liquid portions of well fluid entering the gas separator to separate from gas portions, and causing the rotor to pump the liquid portions up the tubing; and (f) allowing the rotor and the drive shaft to move downward in unison relative to the tubing as the drive rods are rotated in response to stretching of the rods.

17. The method according to claim 16, wherein during step (f), the rotary member of the gas separator moves axially in unison with the drive shaft.

18. The method according to claim 16, wherein step (d) occurs after the rotor has entered the stator in step (c).

19. The method according to claim 16, wherein during step (f), the drive shaft moves axially relative to the rotary member.

* * * * *